United States Patent [19]

Reed

[11] 4,139,100

[45] Feb. 13, 1979

[54] GUN RACK

[76] Inventor: Presley O. Reed, 4678 Bowen Ave., Memphis, Tenn. 38122

[21] Appl. No.: 858,412

[22] Filed: Dec. 7, 1977

[51] Int. Cl.[2] ..... A47F 7/00

[52] U.S. Cl. ..... 211/4; 211/64

[58] Field of Search ..... 211/4, 7, 8, 9, 60, 211/64; 248/203, 201; 70/58; 224/42, 45 R

[56] References Cited

U.S. PATENT DOCUMENTS

| | | | |
|---|---|---|---|
| 2,593,049 | 4/1952 | Paul | 211/8 |
| 2,667,274 | 1/1954 | Diebold | 211/64 |
| 2,958,423 | 11/1960 | Caloiero et al. | 211/64 X |
| 3,291,317 | 12/1966 | Bowen | 211/4 |
| 4,014,466 | 3/1977 | Wess et al. | 211/60 R X |
| 4,063,646 | 12/1977 | Stahl, Jr. | 211/4 |

*Primary Examiner*—Roy D. Frazier
*Assistant Examiner*—Terrell P. Lewis
*Attorney, Agent, or Firm*—John J. Kowalik

[57] ABSTRACT

A gun rack which comprises a vertical row of vertically spaced clamp-shaped barrel supports and a vertical row of stock supports spaced laterally from respective barrel supports. Each pin is fixed at one end to the gun rack frame and adapted to pass through the trigger guard of a gun mounted thereon. The free ends of the pins extend through openings in a vertical locking bar and are angled downwardly for biasing the bar downwardly and thus urge a locking tongue on the lower end of the bar into a vertical aperture provided in the outer end of a locking lug which extends outwardly from the frame in vertical alignment with the pins, whereby to remove the bar it must be elevated upwardly against the cumulative resistance of the pins, thus inhibiting removal by a child. The bar is primarily secured by a lock which has its hasp extended through alignable apertures in the upper end of the bar and an upper securing lug extending from the frame.

11 Claims, 7 Drawing Figures

FIG. 1
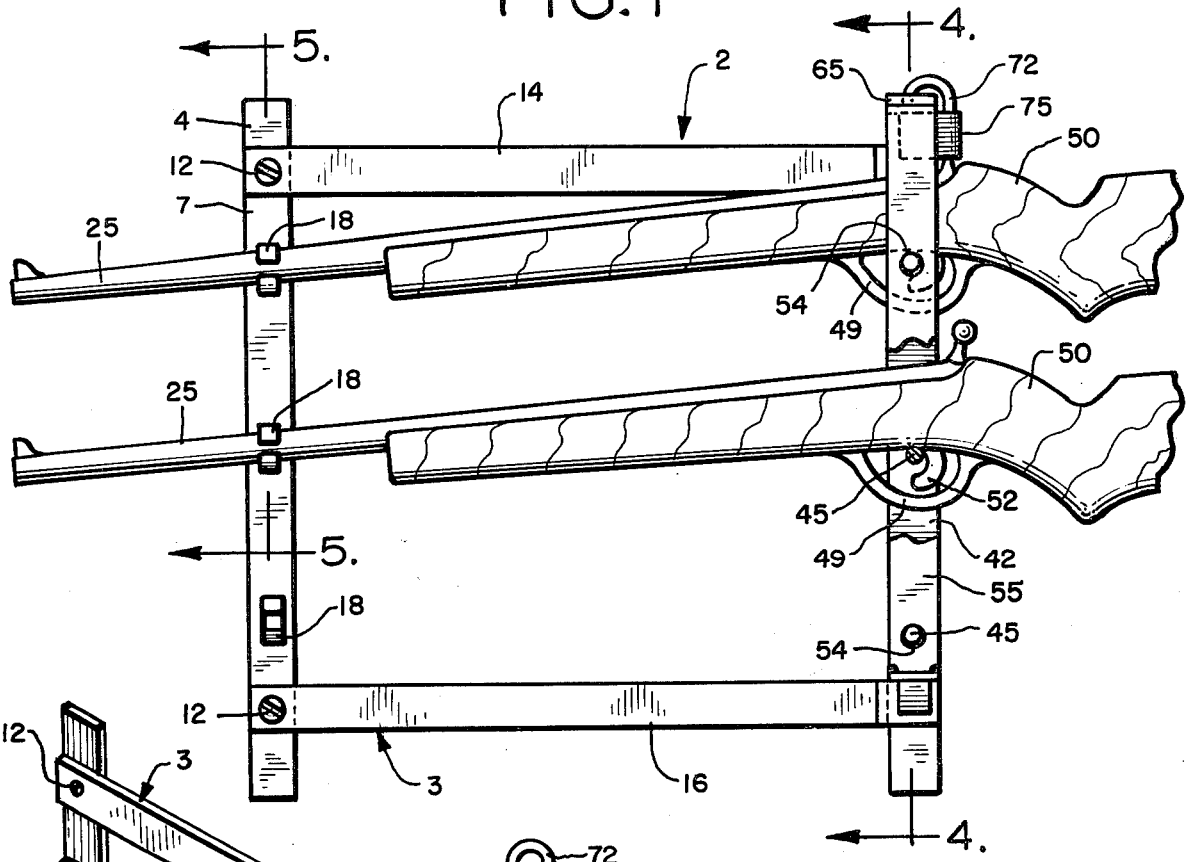
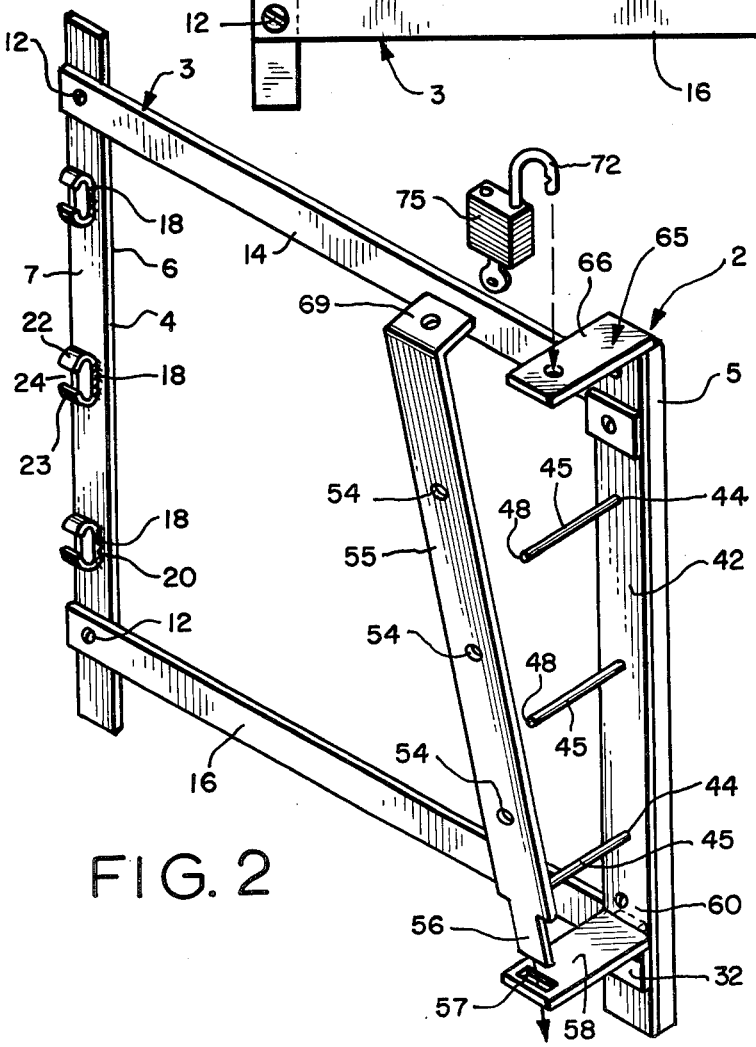
FIG. 2
FIG. 3
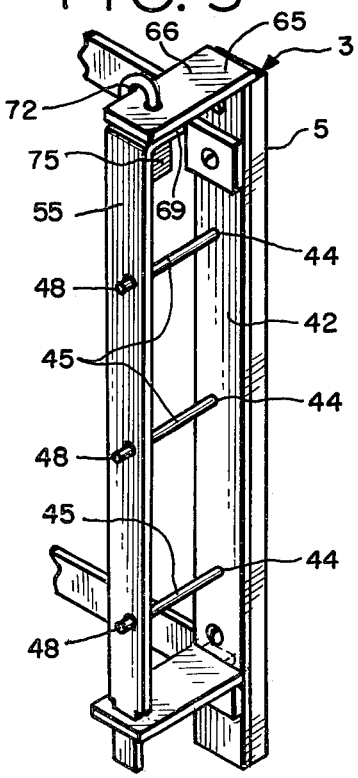

GUN RACK

DISCUSSION OF THE PRIOR ART

As best known to the applicant, the prior art comprises various types of racks including spaced supports which are variously locked to the guns. These are expensive and primarily depend on a lock and key securement. By simply opening the lock, easy access is obtained. Any supplementary locks are complex or ineffective.

SUMMARY OF THE INVENTION

A primary object is to provide a novel gun rack which is made of simply, easily fabricated parts and which cooperated in a novel manner to provide a relatively safe, releasable supplementary locking arrangement which would normally frustrate attempts of a child to unlock, but which is readily releasable by an older, more mature person.

A general object is to provide a rack in which the parts serve multiple functions of not only supporting the gun, but also in maintaining the parts in locked condition. A more specific object is to provide a rack which comprises a frame mounting resilient pins at one of their ends, the free end of the pins extending through openings in a locking bar and the pins being sprung transversely and urging the bar into locking position with an associated locking member secured to the frame, the bar being adapted to be moved endwise by flexing the pins to withdraw the bar from the locking member.

The invention comprehends a novel and easily fabricated gun rack which may be collapsed for shipping and in which the parts are arranged in mutually supportive relation.

These and other objects and advantages inherent in and encompassed by the invention will become readily apparent from the specification and the drawings, wherein:

FIG. 1 is a side elevational view of the novel structure, showing rifles mounted therein:

FIG. 2 is an exploded perspective view of the novel gun rack;

FIG. 3 is a fragmentary perspective view of one end of the gun rack showing the parts in locked position;

DESCRIPTION OF THE INVENTION

Figure 5:
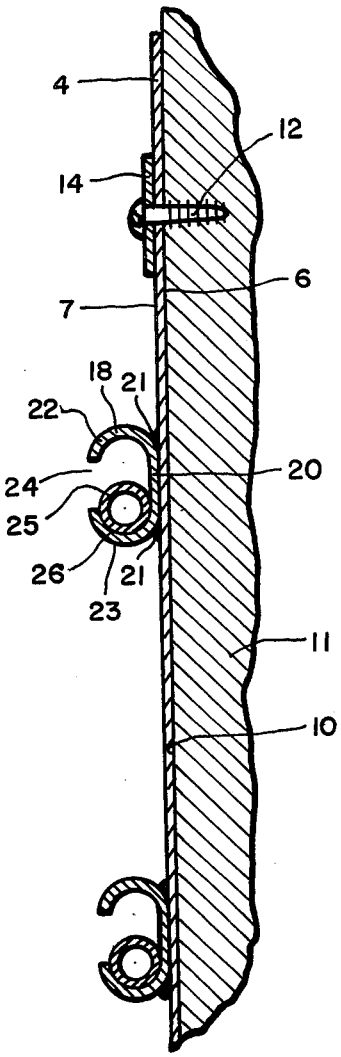
FIG. 5 is a vertical cross-sectional view taken substantially on line 5—5 of FIG. 1.

The gun rack generally designated 2 in the drawings comprises a rectangular, preferably steel frame 3 which includes a pair of laterally spaced upright standards stiles or bars 4 and 5.

The standard 4 is preferably a flat bar having flat inner and outer sides 6 and 7. The inner side of bar 4 is adapted to lay against the wall surface 10 of wall 11 and is secured thereto as by screws 12 which also extend through openings in the adjacent ends of upper and lower cross-members of bars 14 and 16 of the rectangular frame. A vertically spaced series of C-shaped gun-barrel holders 18,18, each of which is secured at its base section 20 (FIG. 5) as by welding at 21,21 to the front side 7 of the standard 4. The upper and lower end portions or jaws 22,23 of each holder or clamp 18 are vertically displaced to provide an access space 24 for a gun barrel 25 of an associated gun mounted therein which rests within the crook 26 of the lower jaw 23. However, the space 24 may be less than the diameter of the gun barrel and the gun withdrawn and inserted endwise.

The other end portions 29,30 of the horizontal cross bars 14,16 are offset outwardly and are connected by offset portions 31,32 to the respective bars 14 and 16. The offset portions 31,32 seat against the external side of one of the legs 34 of the upright stand 5 which is U-shaped in cross-section having its bight portion 35 bearing against the wall surface 10 and secured thereto by screws 37,37 which extend through openings in the portion 35 and thread into the wall. The U-shaped standard 5 has an outer leg or flange 38 which is caterminous at edge 39 with edge 40 of leg or flange 34 and provides a flat seat therewith to mount a retaining-reinforcing bar 42 thereagainst.

The bar 42 has a series of vertically spaced holes 44, one for each resilient mounting pin or rod 45, equal in number to the C-shaped holders or sockets 18,18 and positioned generally in horizontal alignment with the respective thereof.

Each pin 45 is preferably a resilient steel member and is secured as by welding at its inner end 47 (FIG. 4) to the inner side of the bight portion 35 of standard 5, and each pin extends intermediate its ends through a respective aperture 44 in the retaining and reinforcing bar 42. Each pin has a free end 48 and is deflectible vertically as well as laterally. The pins each extend through a trigger guard 49 of the rifle 50 in front of the trigger 52 thereof and the free ends of the pins extend through horizontally aligned openings 54 in a locking bar 55.

Figure 4:
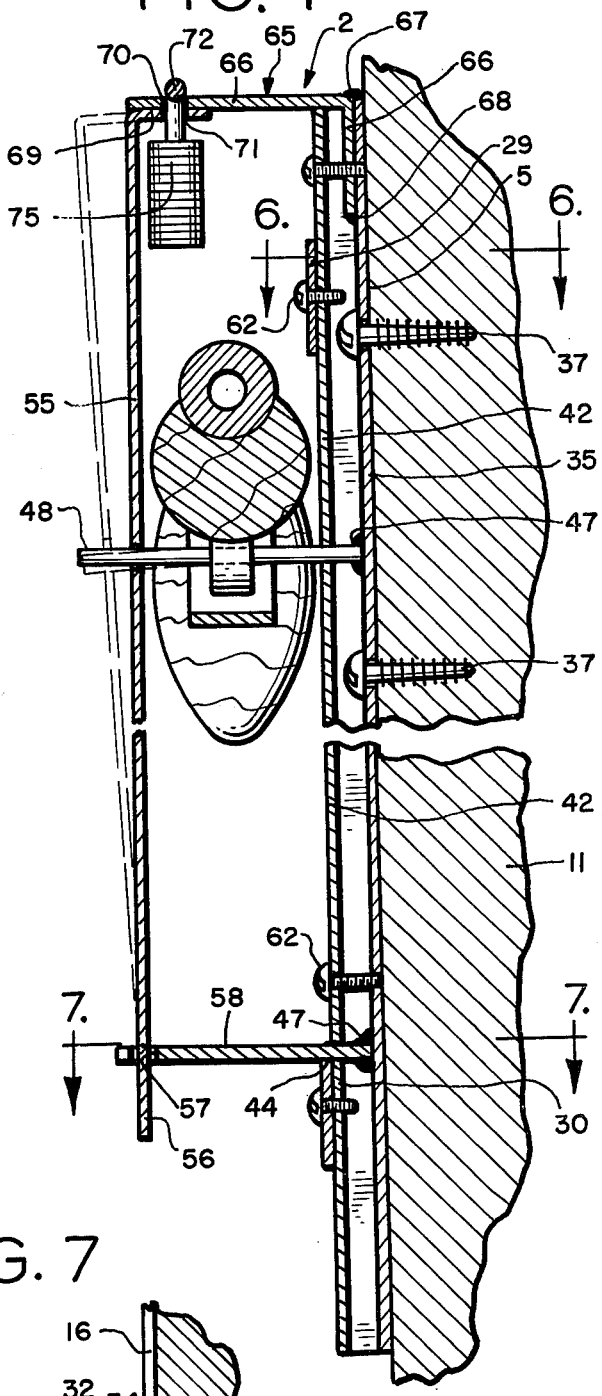
FIG. 4 is a vertical cross-sectional view taken substantially on line 4—4 of FIG. 1.
Figure 6:
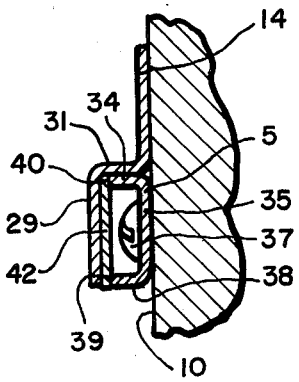
FIG. 6 is a horizontal cross-sectional view taken substantially on line 6—6 of FIG. 4.
Figure 7:
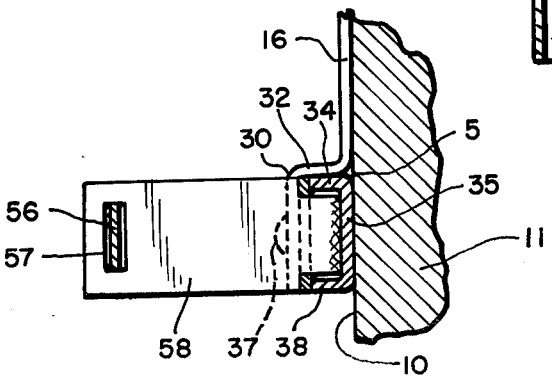
FIG. 7 is a horizontal cross-sectional view taken substantially on line 7—7 of FIG. 4.

The locking bar 55 is positioned outwardly of the guns as best seen in FIGS. 1 and 4, and at its lower end is provided with a narrow, rectangular locking lug 56 which fits loosely into a complemental vertical rectangular slot 57 in the outer end of a horizontal securing lug 58, which at its inner end is secured as by welding to the inner side of bight portion 35 of standard bar 5 directly below the lower edge of the end portion 30 of the lower member 16 of the frame rack whereat said portion 16 is secured to the bar 42. The bar 42 is secured as by screws 62 to the member 5, which in order to make the same non-removable may be welded to bar 5.

An L-shaped locking member 65 is provided at the upper end of the mounting bar 5 and comprises a vertical leg 66 which is welded at 67,68 to the upper end and front of the portion 35 and upright 5 between the legs thereof. The locking member 65 has a horizontal leg 66 which extends outwardly of the frame and is superposed over a horizontal inwardly extending leg 67 at the upper end of the locking bar 55. A pair of vertically alignable holes 70,71 are provided in the legs 66,67 to receive the hasp 72 of a key lock 75.

In opening the rack the lock hasp is removed and the locking bar is moved outwardly, it being understood that sufficient clearance is provided between the upper and lower ends of the locking bar and the cooperating locking elements. In angling the locking bar the pins are sprung downwardly resisting removal of the locking bar whereby inhibiting young children from access to the guns since the parts must be pryed open. After the locking bar clears the pins, the guns may be removed. In locking the guns they are placed barrel end into the respective holders and the gun swung toward the wall to admit the respective pin through the trigger guard. The lower end lug is entered into the slot 57 and the pins 45 are serially entered into their respective openings 54 from bottom to top, springing each pin down into alignment with its respective opening 54, until the lug 67 is pushed under the leg 66 by springing or deflecting all of the pins down. The openings 70,71 are aligned and the lock is applied.

It will be noted that by locating the reinforcing bar intermediate the ends of the pins, excessive stresses on the weld connections of the pins are eliminated and that the reinforcing bar serves as a cover for the screws securing standard 5 to the wall to resist removal.

Having described a preferred embodiment of the invention, various modifications of the invention will now become apparent which come within the scope of the appended claims.

I claim:

1. A gun rack having a wall mounting frame, gun-barrel mounting means on the frame and gun-trigger-guard-receiving means on the frame spaced laterally from the barrel mounting means, locking means associated with said guard-receiving means, said guard-receiving means extending through said locking means when the latter is in the locked position, and being resilient and flexible and operative to bias said locking means to locking position, and said locking means yieldably resisting disconnection of the guard-receiving means therefrom.

2. The invention according to claim 1 and said guard-receiving means comprising a resilient pin and said locking means sleeved on the pin and urged thereby into locking position.

3. The invention according to claim 2 and said locking means comprising a bar and a locking element on the frame having an aperture receiving said bar therein.

4. The invention according to claim 1 and said locking means comprising a locking bar having a locking portion, a locking element mounted in the frame having an aperture receiving said locking portion, said guard-receiving means having interlocking engagement with said locking bar and biasing said bar into locking engagement within said aperture.

5. The invention according to claim 4 and said bar extending transversly to said guard-receiving means and said guard-receiving means comprising laterally deflectible pins.

6. The invention according to claim 4 and said locking portion being disposed at one end of said bar and another locking element on the frame abutting the other end of the bar.

7. The invention according to claim 1 and said guard-receiving means comprising a pin anchored at one end to said frame reinforcing means embracing said pin intermediate the ends thereof.

8. The invention according to claim 1 and said barrel-mounting means comprising C-shaped holders and said guard-receiving means comprising outwardly extending pins on the frame.

9. The invention according to claim 8 and said locking means comprising a bar extending lengthwise transversely of said pins and receiving the same therethrough.

10. A gun rack having a wall mounting frame, gun-barrel mounting means on the frame and gun-trigger-guard-receiving means on the frame spaced laterally from the barrel mounting means, locking means associated with said guard-receiving means, said guard-receiving means operative to bias said locking means to locking position, and said guard receiving means comprising a pin anchored at one end to said frame and reinforcing means embracing said pin intermediate the ends thereof, and said reinforcing means comprising a bar having an aperture receiving said pin therethrough, and means securing said bar to said frame.

11. A gun rack comprising:

a pair of opposed stiles, gun support means projecting from each of said stiles, one of said support means comprising a row of trigger-guard receiving pins, a securing member mounted at one end of said row of pins, and having a vertical locking - bar receiving aperture therein, an elongated locking bar positionable in alignment with said pins and having a series of openings spaced on the order of the spacing of the pins for receiving respective pins in respective openings, said pins being resilient and transversely deflectible, a locking member mounted at the other end of the row of pins and spaced a distance from the securing member less than the length of said locking bar, said locking bar, while mounted on said pins, having one end insertable into said aperture and being movable endwise by deflecting said pins to a position disposing said locking bar in locking association with the locking member.

* * * * *